US009365979B2

(12) United States Patent
Castro et al.

(10) Patent No.: US 9,365,979 B2
(45) Date of Patent: Jun. 14, 2016

(54) METHOD OF INCREASING PAPER SURFACE STRENGTH BY USING POLYALUMINUM CHLORIDE IN A SIZE PRESS FORMULATION CONTAINING STARCH

(71) Applicant: Ecolab USA Inc., Naperville, IL (US)

(72) Inventors: David J. Castro, DeKalb, IL (US); William Andrews, Parker, CO (US); Daniel E. Schwarz, Naperville, IL (US)

(73) Assignee: ECOLAB USA INC., Naperville, IL (US)

( * ) Notice: Subject to any disclaimer, the term of this patent is extended or adjusted under 35 U.S.C. 154(b) by 0 days.

(21) Appl. No.: 14/470,686

(22) Filed: Aug. 27, 2014

(65) Prior Publication Data

US 2016/0060812 A1 Mar. 3, 2016

(51) Int. Cl.
*D21H 17/37* (2006.01)
*D21H 19/54* (2006.01)

(52) U.S. Cl.
CPC ..... *D21H 19/54* (2013.01)

(58) Field of Classification Search
USPC ..... 162/175; 524/72
IPC ..... D21H 17/37; C08L 97/005
See application file for complete search history.

(56) References Cited

U.S. PATENT DOCUMENTS 5,627,224 A * 5/1997 Lyrmalm ..... D21H 17/15 524/437
6,207,258 B1 3/2001 Varnell
7,211,608 B2 5/2007 Niinikoski et al.
7,553,395 B2 6/2009 Stoffel et al.
7,582,188 B2 9/2009 Stoffel et al.
8,088,250 B2 1/2012 Cheng et al.
8,512,521 B2 8/2013 Lackinger et al.
2004/0171719 A1* 9/2004 Neivandt ..... C08L 3/00 524/47
2006/0228499 A1 10/2006 Tran et al.
2010/0129553 A1 5/2010 Jackson et al.
2011/0104407 A1* 5/2011 Zhou ..... B41M 5/0035 428/32.1

FOREIGN PATENT DOCUMENTS

EP 0677125 B1 5/1996
EP 0333368 B1 6/1996
EP 0522940 B1 9/1996

OTHER PUBLICATIONS

Enco Engineering GmbH Switzerland, "Polyaluminium Chloride Technology", www.enco.ch/pac.htm, accessed Dec. 8, 2015.
Gulbrandsen, "Sulfated Polyaluminum Chloride (Sulfated PAC)", www.guldbrandsen.com, accessed Dec. 8, 2015.
International Search Report and Written Opinion from corresponding PCT App. No. PCT/US2015/045989, dated Oct. 29, 2015 (14 pgs.).

* cited by examiner

*Primary Examiner* — Mark Halpern
(74) *Attorney, Agent, or Firm* — Eric D. Babych; Brinks Gilson & Lione

(57) ABSTRACT

Size press formulations and methods of treating a substrate using the size press formulations. The size press formulations may include solids. The solids may include a polyaluminum chloride compound, starch, an optical brightening agent, and a salt. Suitable polyaluminum chloride compounds include phosphated polyaluminum chloride, sulfated polyaluminum chloride, polyaluminum chloride, polyaluminum silica sulfate chloride, and any combination thereof.

11 Claims, No Drawings

METHOD OF INCREASING PAPER SURFACE STRENGTH BY USING POLYALUMINUM CHLORIDE IN A SIZE PRESS FORMULATION CONTAINING STARCH

BACKGROUND

1. Field of the Invention

The present disclosure generally relates to formulations for the treatment of substrates. More particularly, the disclosure relates to size press formulations and methods of treating paper using the size press formulations.

2. Description of the Related Art

A paper mat typically includes water and solids. The solid portion includes fibers (typically cellulose-based fibers) and can also include filler. Increasing the strength of the paper mat would allow one to increase the proportion of solids that is filler content. This would be desirable because it reduces raw materials costs, reduces energy needed in the papermaking process, and increases the optical properties of the paper.

Fillers are mineral particles that are added to a paper mat during the papermaking process to enhance the resulting opacity and light reflecting properties of the paper. Fillers are mostly inorganic particles or pigments used to increase the opacity or brightness, reduce the porosity, and/or reduce the cost of the paper or paperboard. Some examples of fillers include kaolin clay, talc, titanium dioxide, alumina trihydrate, barium sulfate, magnesium hydroxide, pigments such as calcium carbonate, and the like.

Calcium carbonate filler comes in two forms, ground calcium carbonate (GCC) and precipitated calcium carbonate (PCC). GCC is naturally occurring calcium carbonate rock and PCC is synthetically produced calcium carbonate. Because it has a greater specific surface area, PCC has greater light scattering abilities and provides better optical properties to the resulting paper. For the same reason, however, PCC filled paper mat produces paper that is weaker than GCC filled paper.

Paper strength is a function of the number and the strength of the bonds formed between interweaved fibers of the paper mat. Filler particles with greater surface area are more likely to become engaged to those fibers and interfere with the number and strength of those bonds. Due to its greater surface area, PCC filler interferes with those bonds more than GCC. As a result, papermakers are forced to make an undesirable tradeoff. They must either choose to select a paper with superior strength but inferior optical properties or they must select a paper with superior optical properties but inferior strength.

Increasing filler loadings, such as PCC, while maintaining basis weight in an uncoated free sheet is desirable due to gains in optical properties and the cost difference between filler particles and fibers. However, as mentioned above, papermakers are limited in the amount of fillers in the final product due mostly to a net loss in strength. Tensile strength, z-directional tensile strength, and the tendency of the paper to shed filler particles (i.e. dusting) during typical handling processes, such as printing, are some of the main properties affected.

BRIEF SUMMARY

The present disclosure relates to size press formulations and methods for treating substrates with the size press formulations.

In one embodiment, a size press formulation comprises solids, the solids comprising a polyaluminum chloride compound and starch.

In another embodiment, a dried substrate surface comprises a polyaluminum chloride compound and starch.

In an additional embodiment, a method of treating a substrate surface is disclosed. The method comprises adding a size press formulation comprising solids to the substrate surface, wherein the solids comprise a polyaluminum chloride compound and starch.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

Not applicable.

DETAILED DESCRIPTION

Various embodiments of the present disclosure are described below. The relationship and functioning of the various elements of the embodiments may better be understood by reference to the following detailed description. However, embodiments are not limited to those explicitly described below.

The processes described in the present disclosure can be practiced on conventional papermaking equipment. Although papermaking equipment varies in operation and mechanical design, the processes by which paper is made on different equipment contain common stages. Papermaking typically includes a pulping stage, a bleaching stage, a stock preparation stage, a wet end stage and a dry end stage.

In the pulping stage, individual cellulose fibers are liberated from a source of cellulose by mechanical and/or chemical action. The pulp is suspended in water in the stock preparation stage. The wet end stage of the papermaking process comprises depositing the stock suspension or pulp slurry on the wire or felt of the papermaking machine to form a continuous web of fibers, draining of the web, and consolidation of the web ("pressing") to form a sheet. In the dry end stage of the papermaking process, the web is dried and may be subjected to additional processing like passing it through a size press, calendering, spray coating with surface modifiers, printing, cutting, corrugating and the like. In addition to using a size press and/or a calender waterbox, the dried paper can be coated by spray coating using a sprayboom.

The present disclosure contemplates using a size press formulation in one or more stages of the papermaking process described above. The size press formulation may in some embodiments be in the form of an emulsion or dispersion and in other embodiments, the formulation may be aqueous-based solution. The formulation may also include any additional chemicals that may be used in a typical size press formulation, such as silica or other fillers, optical brightening agents, defoamers, biocides, and any combination thereof.

A typical papermaking machine includes components such as a dryer, a calendering system, and a surface sizing system. The surface sizing system comprises a size press which applies surface sizing agents or other compounds, such as optical brightening agents, starch, etc., to the surface of the paper. Generally, a size press applies various solutions or formulations to the surface of paper. The paper may have been dried or partially dried before treatment by the size press. The size press may add a formulation or solution of chemicals, such as surface sizing agents, to the paper using a puddle and nip between rolls or by metering the solution onto a rubber roll, for example.

In some embodiments, the surface sizing agents are part of a formulation, such as a size press formulation. The size press formulation may be an aqueous solution or an emulsion or dispersion, for example. The formulation comprises sizing agents. Such size press formulations may be coated onto the paper sheet. Specifically, the formulations may be added at the size press, along with any additional sizing components or agents that are not in the formulation.

In some embodiments, the size press formulation is applied to the substrate as a surface treatment. The size press formulation may be applied to the substrate (e.g. paper) using any method known to one of ordinary skill in the art and it may be applied to one, two, three, or more different sides of the substrate. For example, if the substrate is paper, the size press formulation may be applied to one side of the paper or both sides of the paper.

In general, the size press formulation is applied at or near the size press, although the formulation can certainly be applied at other locations in the papermaking process. In most instances, the size press is situated downstream of a first drying section. The size press formulation may be applied using conventional size presses, although other components/techniques (e.g. spraying, doctor bar, or other conventionally used coating equipment) may be used to apply the size press formulation.

It should be noted that application of chemicals at, near, or after the size press may be differentiated from application of chemicals at the wet end of the papermaking machine. One difference relates to the fact that the paper is dried, or at least somewhat dried, before it arrives at the size press.

The presently disclosed size press formulation may include various components. Further, the formulation may be aqueous-based, hydrocarbon based, organic solvent based, emulsion based (water-in-oil, oil-in-water), etc. As noted above, in some embodiments, the size press formulation is added to the substrate at or near the size press.

With respect to the components of the size press formulation, which may be referred to as "solids" in certain embodiments, any commonly used size press additives, such as starch or other chemicals commonly added to uncoated paper, may be utilized. The size press formulation also comprises one or more polyaluminum chloride compounds (PAC). In one aspect, the size press formulation may be aqueous-based, comprising water, starch, and one or more PAC.

In some embodiments, the size press formulation is an aqueous formulation comprising solids. The solids may comprise one or more PAC. The solids may also comprise starch or a combination of starch and one or more PAC. Further, the solids may include any other additives that are commonly added at the size press, such as optical brightening agents and salts. The salts may be, for example, sodium chloride or calcium chloride.

In the present application, the term "solids" refers to the non-water or non-solvent components of the formulation. The weight percent of these components is determined by weighing the mass that remains after extracting the water or solvent from the formulation under mild conditions, e.g., evaporation in a 105° C. oven. The "solids" are not necessarily materials in a solid phase suspended in solution. In fact, most often the "solids" in solution are solubilized and thus, they are in the liquid phase.

In some embodiments, the size press formulation comprises from about 10% to about 15% by weight solids. In certain embodiments, the solids comprise at least about 80% starch, about 10% to about 15% salt, and about 5% to about 10% optical brightening agent. In some embodiments, the solids comprise from about 5% to about 20% PAC.

As noted above, the solids of the size press formulation may comprise from about 5% to about 20% of one or more PAC (in the form of $Al_2O_3$). All percentages recited herein are by weight and based upon the weight of a composition, solution, mixture, or paper, as appropriate, unless stated otherwise. In other aspects, the solids of the formulation may comprise from about 6% to about 17% of one or more PAC, which is equivalent to about 10 to about 30 pounds of $Al_2O_3$ per ton of dry paper (lb/ton). In one aspect, the solids of the aqueous formulation comprise about 10% of one or more PAC.

The pH of the size press formulation is not particularly limited to any specific pH or pH range. In some embodiments, the pH of the size press formulation is from about 3 to about 8.

With respect to the PAC component of the size press formulation, any PAC may be used in accordance with the present disclosure. In some embodiments, the PAC is selected from the group consisting of phosphated polyaluminum chloride, sulfated polyaluminum chloride, polyaluminum chloride, polyaluminum silica sulfate chloride, and any combination thereof. In one embodiment, the PAC is phosphated polyaluminum chloride.

EXAMPLES

Several laboratory experiments have been conducted to measure the ability of various PAC compounds to increase the surface strength of paper as well as to improve the ink holdout ability. For all of the studies, base paper containing about 16% ash that has not been passed through a size press was coated using the drawdown method with solutions containing the desired chemistries. The paper was weighed before and after coating to determine the specific chemical dose. The paper was also dried by passing it once through a drum dryer at about 95° C. and then it was allowed to equilibrate at about 23° C. and about 50% relative humidity for at least 12 hours.

Starch dosage is reported in units of pounds of dry starch per ton of dry paper. PAC dosage is reported in units of pounds of dry $Al_2O_3$ equivalents per unit of dry paper.

Surface strength was measured using TAPPI (Technical Association of Pulp and Paper Industries) method T476 om-01. In this measurement, the surface strength is inversely proportional to the amount of mass lost from the surface of the paper after having been systematically "rubbed" on a turn table by two abrasion wheels. The results are reported in mg of lost material per 1,000 revolutions. The lower the number, the stronger the surface.

Optical density is a measure of the printed color intensity. An approximately 2×4 $in^2$ black rectangle was printed on the coated samples using a typical office inkjet printer and only black ink. The printed samples were allowed to dry under controlled relative humidity (about 50%) and temperature (about 23° C.) for a few minutes (e.g. about 3 to about 10 minutes). An X-Rite™ 500 Series Spectrodensitometer was used to measure the black optical density on the printed areas.

Below is a summary of the studies conducted in the laboratory.

Study 1—Screening Studies.

A first study was conducted to determine the performance of two distinct, commercially available products containing PAC; PAC 1 and PAC 2. PAC 1 is an aqueous formulation comprising about 15% phosphated polyaluminum chloride. PAC 2 is an aqueous formulation comprising about 10% sulfated polyaluminum chloride.

TABLE 1

| Condition | PAC | Starch, lb/ton | PAC ($Al_2O_3$), lb/ton | Abrasion loss, mg/1000 revs | Optical density |
|---|---|---|---|---|---|
| 1 | — | 17 | 0.00 | 1136 | 1.07 |
| 2 | — | 26 | 0.00 | 1040 | 1.08 |
| 3 | — | 33 | 0.00 | 928 | 1.08 |
| 4 | PAC 1 | 25 | 1.03 | 1049 | 1.07 |
| 5 | PAC 1 | 25 | 1.54 | 1003 | 1.08 |
| 6 | PAC 1 | 24 | 2.01 | 985 | 1.08 |
| 7 | PAC 1 | 24 | 2.96 | 890 | 1.09 |
| 8 | PAC 2 | 24 | 1.00 | 1005 | 1.09 |
| 9 | PAC 2 | 23 | 1.39 | 1000 | 1.10 |
| 10 | PAC 2 | 23 | 1.92 | 985 | 1.11 |
| 11 | PAC 2 | 23 | 2.85 | 931 | 1.12 |

In Table 1, conditions 1-3 only contain starch and are intended to provide a measure of the performance of starch as a surface strength additive. Conditions 4-11 are to be compared to condition 2 as they all contain a similar amount of starch.

The results clearly show that somewhere between about 2 and about 3 lb/ton PAC, the resulting surface strength surpasses the additional 7 lb/ton starch (between 26 and 33 lb/ton starch in conditions 2 and 3), while providing modest increases in printed optical density.

A second study was conducted to enhance the resolution of the PAC 1 result observed in Table 1 and to screen for a few additional chloride containing compounds. Table 2 reproduces the PAC 1 earlier observation at a greater dose. This study also revealed that aluminum chloride performed well in optical density but not as well as the PACs with respect to surface strength at comparable levels of starch. Chloride containing compounds COM 6 and COM 7 offer a performance level that is half of what PAC 1 offers. COM 6 is an aqueous formulation comprising aluminum citrate stabilized with ammonia, COM 7 is an aqueous formulation comprising aluminum tri lactate, and COM 5 is an aqueous formulation comprising aluminum lactate.

TABLE 2

| Condition | Compound | Starch, lb/ton | Compound ($Al_2O_3$), lb/ton | Abrasion loss, mg/1000 revs |
|---|---|---|---|---|
| 1 | — | 15 | 0.00 | 1126 |
| 2 | — | 20 | 0.00 | 1055 |
| 3 | — | 26 | 0.00 | 910 |

TABLE 2-continued

| Condition | Compound | Starch, lb/ton | Compound ($Al_2O_3$), lb/ton | Abrasion loss, mg/1000 revs |
|---|---|---|---|---|
| 4 | PAC 1 | 19 | 7.41 | 645 |
| 5 | COM 6 | 20 | 1.57 | 996 |
| 6 | COM 6 | 19 | 7.38 | 935 |
| 7 | COM 7 | 21 | 1.61 | 988 |
| 8 | COM 7 | 21 | 8.01 | 896 |
| 9 | COM 5 | 20 | 1.56 | 997 |
| 10 | COM 5 | 18 | 6.94 | 1027 |

Study 2—Isolating the pH Effect on Surface Strength.

It could be hypothesized that the strong acidifying effect of PACs is responsible for the paper surface strengthening. More specifically, during the coating of an acid solution, $CaCO_3$-based fillers are solvated and dissociated effectively allowing direct fiber-fiber contact during the re-formation of the paper surface. Because these more intimate fiber-fiber contacts are ultimately responsible for the strength of the paper, the resulting dry paper is stronger.

To test this hypothesis, sheets were coated with a PAC formulation of a known pH. A starch-only formulation was then brought to that same pH by adding hydrochloric acid (HCl). The abrasion loss results shown in Table 3 demonstrate that the pH-adjusted starch solutions were not able to improve the surface strength of the paper as much as the PAC-containing formulations. In fact, a statistical analysis of the results indicates that the PAC-containing conditions resulted in statistically significant decreases in abrasion loss (higher surface strength), while the pH-adjusted solutions did not (the 95% confidence interval of the sample distributions is 44 mg/1000 revs, with the number of replicas per condition equal to 5).

TABLE 3

| Condition | Starch, lb/ton | PAC 2 ($Al_2O_3$), lb/ton | HCl | $pH_{before\ adjustment}$ | $pH_{after\ adjustment}$ | Abrasion loss, mg/1000 revs |
|---|---|---|---|---|---|---|
| 1 | 19 | 0.0 | 0 | — | — | 1115 |
| 2 | 27 | 0.0 | 0 | — | — | 921 |
| 3 | 33 | 0.0 | 0 | — | — | 830 |
| 4 | 18 | 4.5 | 0 | 3.81 | — | 985 |
| 5 | 32 | 4.1 | 0 | 3.61 | — | 711 |
| 6 | 19 | 0.0 | 1 drop | 6.63 | 2.82 | 1071 |
| 7 | 32 | 0.0 | 1 drop | 6.84 | 3.17 | 804 |

Study 3—pH Control with PACs.

A papermaker would be prevented from using certain PACs in size press applications because sometimes there is a strong acidifying effect on the formulation. To circumvent this pH effect, two distinct chloride containing compounds with pH values close to neutral were tested. COM 8 is an aqueous solution comprising aluminum citrate stabilized with ethylene diamine and COM 9 is a lab blend of aluminum citrate stabilized with ammonia.

TABLE 4

| Condition | COM | Starch, lb/ton | COM ($Al_2O_3$), lb/ton | Abrasion loss, mg/1000 revs | Predicted opacity at 80 g/m$^2$ | Brightness | Whiteness | pH (@55° C.) | Optical density |
|---|---|---|---|---|---|---|---|---|---|
| 1 | — | 18 | 0.00 | 1073 | 94.8 | 91.1 | 102.3 | — | 1.05 |
| 2 | — | 28 | 0.00 | 973 | 94.0 | 91.2 | 102.0 | 6.71 | 1.06 |
| 3 | — | 31 | 0.00 | 825 | 94.9 | 90.9 | 100.8 | — | 1.05 |
| 4 | COM 8 | 24 | 2.01 | 909 | 95.1 | 89.9 | 98.8 | 6.36 | 1.07 |
| 5 | COM 8 | 25 | 6.11 | 851 | 95.7 | 88.5 | 93.2 | 6.19 | 1.13 |

TABLE 4-continued

| Condition | COM | Starch, lb/ton | COM ($Al_2O_3$), lb/ton | Abrasion loss, mg/1000 revs | Predicted opacity at 80 g/m$^2$ | Brightness | Whiteness | pH (@55° C.) | Optical density |
|---|---|---|---|---|---|---|---|---|---|
| 6 | COM 9 | 26 | 2.09 | 887 | 93.7 | 91.7 | 103.4 | 6.77 | 1.07 |
| 7 | COM 9 | 26 | 6.43 | 787 | 94.5 | 91.4 | 102.9 | 6.57 | 1.07 |

Table 4 shows that the solutions containing the chloride containing compounds with close to neutral pH were equally capable of strengthening the paper surface. Due to the nature of the formulation of these products, one of the two had negative effects on other properties of the paper, namely brightness and whiteness, while still slightly enhancing the optical density on printed areas.

Study 4—Final Screening.

A final screening study was conducted to probe a larger PAC dosage range as well as to investigate other commercially available PACs.

TABLE 5

| Condition | Chemistry | Starch, lb/ton | Dose, lb/ton | Abrasion loss, mg/1000 revs | Optical density |
|---|---|---|---|---|---|
| 1 | — | 27 | 0 | 966 | 1.04 |
| 2 | — | 33 | 0 | 800 | 1.07 |
| 3 | — | 46 | 0 | 690 | 1.05 |
| 4 | Polymer | 29 | 5 | 755 | 1.05 |
| 5 | Polymer | 28 | 14 | 671 | 1.02 |
| 6 | PAC 1 | 35 | 6 | 741 | 1.14 |
| 7 | PAC 1 | 32 | 16 | 416 | 1.51 |
| 9 | COM 3 | 33 | 16 | 645 | 1.50 |
| 10 | PAC 2 | 28 | 5 | 819 | 1.12 |
| 11 | PAC 2 | 25 | 12 | 602 | 1.51 |
| 12 | COM 9 | 37 | 6 | 803 | 1.05 |
| 13 | COM 9 | 35 | 17 | 734 | 1.07 |
| 16 | PAC 4 | 33 | 5 | 669 | 1.18 |
| 17 | PAC 4 | 25 | 12 | 419 | 1.37 |
| 18 | PAC 10 | 36 | 6 | 726 | 1.13 |
| 19 | PAC 10 | 31 | 15 | 438 | 1.50 |

Table 5 shows that both surface strength and optical density respond positively to a PAC dose within the 0 to 15 lb/ton range (reported as $Al_2O_3$) and that the magnitude varies with the type of PAC. The rows labeled "polymer" correspond to a non-PAC organic polymer, which is known to increase paper surface strength. PAC 4 is an aqueous formulation comprising polyaluminum chloride and PAC 10 is an aqueous formulation comprising about 10% polyaluminum silica sulfate chloride. In view of the foregoing, it can clearly be seen that certain PAC compounds in size press formulations containing starch strengthen the paper surface.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a PAC" is intended to include "at least one PAC" or "one or more PAC."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A size press formulation comprising solids, the solids comprising a polyaluminum chloride compound (PAC) and starch, wherein the polyaluminum chloride compound is phosphated polyaluminum chloride.

2. The formulation of claim 1, wherein the solids further comprise an optical brightening agent.

3. The formulation of claim 1, wherein the solids further comprise a salt.

4. The formulation of claim 1, further comprising water.

5. The formulation of claim 1, wherein the formulation comprises from about 10 weight % to about 15 weight % of the solids.

6. The formulation of claim 5, wherein the solids comprise a salt and an optical brightening agent, the solids comprise at least about 80 weight % starch, about 10 weight % to about 15 weight % salt, and about 5 weight % to about 10weight % optical brightening agent.

7. The formulation of claim 5, wherein the solids comprise from about 5weight % to about 20 weight % PAC.

8. The formulation of claim 1, wherein a pH of the formulation is from about 3 about 8.

9. The formulation of claim 1, wherein the solids comprise about 10 weight % PAC.

10. A size press formulation comprising solids, the solids comprising a polyaluminuin Chloride compound and starch, wherein the polyaluminum chloride compound is polyaluminum silica sulfate chloride.

11. The formulation of claim 1, wherein the formulation comprises at least 80% by weight of the starch.

* * * * *